US006883987B2

(12) United States Patent
Kamin et al.

(10) Patent No.: US 6,883,987 B2
(45) Date of Patent: Apr. 26, 2005

(54) DEVICE FOR TREATING FORMS, ESPECIALLY BETTING SLIPS

(75) Inventors: Hartmut Kamin, Berlin (DE); Günter Baitz, Berlin (DE); Wolfgang Malke, Berlin (DE)

(73) Assignee: Wincor Nixdorf International GmbH, Paderborn (DE)

( * ) Notice: Subject to any disclaimer, the term of this patent is extended or adjusted under 35 U.S.C. 154(b) by 0 days.

(21) Appl. No.: 10/344,288

(22) PCT Filed: Aug. 14, 2001

(86) PCT No.: PCT/EP01/09397

§ 371 (c)(1),
(2), (4) Date: Feb. 6, 2003

(87) PCT Pub. No.: WO02/13928

PCT Pub. Date: Feb. 21, 2002

(65) Prior Publication Data

US 2003/0156880 A1 Aug. 21, 2003

(30) Foreign Application Priority Data

Aug. 14, 2000 (DE) ..... 100 39 699

(51) Int. Cl.[7] ..... B41J 11/50; B41J 2/315; B41J 5/30; B41L 45/00

(52) U.S. Cl. ..... 400/605; 400/120.01; 400/66; 400/120.16; 101/66

(58) Field of Search ..... 400/605, 120.01, 400/66, 120.16; 101/66; 235/384, 449, 488; 347/197, 111, 153, 140, 112; 358/496, 440, 488, 476, 484

(56) References Cited

U.S. PATENT DOCUMENTS 564,073 A * 7/1896 Hirst ..... 303/77
4,558,373 A * 12/1985 Plasencia et al. ..... 358/484

(Continued)

FOREIGN PATENT DOCUMENTS

| | | | | |
|---|---|---|---|---|
| DE | 37 32 622 | A1 | 4/1989 | |
| DE | 691 21 035 | T2 | 2/1997 | |
| DE | 693 07 815 | T2 | 9/1997 | |
| EP | 0 477 872 | A2 * | 9/1991 | ..... H04N/1/00 |
| EP | 0 677 311 | A2 * | 2/1995 | ..... A63F/3/06 |
| EP | 0 677 311 | A2 | 10/1995 | |
| EP | 0 684 142 | A1 | 11/1995 | |
| EP | 0 718 110 | A1 | 6/1996 | |

*Primary Examiner*—Andrew H. Hirshfeld
*Assistant Examiner*—Wasseem H. Hamdan
(74) *Attorney, Agent, or Firm*—Michaud-Duffy Group LLP

(57) ABSTRACT

The invention relates to a device for treating forms, especially betting slips or the like, comprising a reader with a transport device that forms a gap-type transport path for a betting slip. In the path of said transport path a reading head is disposed and is linked with a control and evaluation unit. In the projection of the at least one vertically aligned transport path a printer is disposed below the reading heat that is linked with the control and evaluation unit. Said printer comprises an abutment and a print head that can be adjusted between an abutment remote rest position and an abutment proximal operative position. Downstream of the abutment and below said abutment a sheet tray is provided.

5 Claims, 2 Drawing Sheets

U.S. PATENT DOCUMENTS 4,605,214 A * 8/1986 Hanning et al. ..... 271/3.08
4,613,747 A * 9/1986 McCarthy ..... 235/480
4,684,792 A 8/1987 Nickels, Jr. ..... 235/384
4,806,744 A * 2/1989 Briane et al. ..... 235/477
4,953,037 A * 8/1990 Ito et al. ..... 358/496
5,136,144 A * 8/1992 Swinton et al. ..... 235/379
5,168,286 A * 12/1992 Okauchi et al. ..... 347/222
5,225,665 A * 7/1993 Zerfahs et al. ..... 235/384
5,268,561 A * 12/1993 Kimura et al. ..... 235/384
5,309,176 A * 5/1994 Faes et al. ..... 347/220
5,461,219 A * 10/1995 Cronvall ..... 235/384
5,599,117 A * 2/1997 Faes et al. ..... 400/605
5,684,285 A * 11/1997 Faes et al. ..... 235/449
5,692,845 A * 12/1997 Faes et al. ..... 400/692
5,818,022 A * 10/1998 Faes et al. ..... 235/384
6,025,936 A * 2/2000 Ishida ..... 358/498
6,042,285 A * 3/2000 Faes et al. ..... 400/624
6,112,989 A * 9/2000 Sheldon ..... 235/384
6,336,275 B1 * 1/2002 Shigyo ..... 33/567
6,338,436 B1 * 1/2002 Iguchi et al. ..... 235/488
6,371,476 B1 * 4/2002 Isogai et al. ..... 271/3.14
6,527,267 B1 * 3/2003 Kuwata et al. ..... 271/9.13

* cited by examiner

DEVICE FOR TREATING FORMS, ESPECIALLY BETTING SLIPS

CROSS-REFERENCE TO RELATED APPLICATIONS

This application is entitled to the benefit of and incorporates by reference essential subject matter disclosed in International Application No. PCT/EP01/09397 filed on Aug. 14, 2001 and German Patent Application No. 100 39699.2 filed on Aug. 14, 2000.

FIELD OF THE INVENTION

The invention concerns a device for processing forms, especially betting slips or the like, including a reading station with a transport mechanism forming a gap-type transport path for the betting slips, and a reading head arranged in the way of the transport path and connected with a control and evaluation unit.

BACKGROUND OF THE INVENTION

Such devices are used for example in Lotto-accepting stations or betting offices. A processing procedure customarily runs in these instances in the following ways. A betting slip filled out by a customer is inserted into the reading station and is sensed by the reading head, for example a scanner. The sensed data are stored and the customer receives back the betting slip or a copy of the same as a receipt. If the customer wants to redeem a win, the betting slip or the receipt copy is again inserted into a reading device. In the control and evaluation unit, a test is made as to whether the captured data corresponds to a winning combination. Subsequently, the presented betting slip must be cancelled in order to avoid misuse by multiple presentations of the same betting slip.

Previously for the carrying out of this process, one needed different devices or integrated cancellation stamps were simply used.

A device of the initially mentioned type is, for example, known from DE 69 121 035 T2. This publication shows a facsimile device with a nearly horizontal transport path for an inwardly running document, which can be sensed by a reading head arranged in the way of the transport path. Arranged downstream of the reading head is a printing mechanism with an ink jet printer movable perpendicularly to the transport direction of the document, which printer can be driven to a rest position provided at one end of the print line. The printing mechanism serves to print onto the rear side of the document, whose content is to be communicated, a communication protocol.

EP 0 718 110 A describes a thermal printer in which the thermal print head is movable between a working position, in which it lies under pressure on a printing roll forming the print backup abutment, and a position in which the thermal print head is lifted from the printing roll.

SUMMARY OF THE INVENTION

The invention has as its object the provision of a device of the initially mentioned type which is so constructed that the execution of the previously described processing procedure is simplified.

This object is solved in accordance with the invention, in that in an extension of the at least nearly vertically directed transport path beneath the reading head is provided a printing mechanism connected with the control and evaluation unit and having a print backup abutment and a print head, which print head is movable between a rest position remote from the print backup abutment and a working position near the print backup abutment, and in that downstream of the print backup abutment and below the same is arranged a sheet tray.

The device according to the invention offers the possibility, on one hand to read in a betting slip, and on the other hand to cancel the betting slip by means of the printing mechanism after the slip has been tested for possible winning combinations. During the reading in of the betting slip, the print head is moved to its rest position so that the betting slip moves through the reading station and is given back to the customer in unchanged condition. For cancellation, the printing head is moved to its working position so that a betting slip presented by the customer for redemption of a possible win immediately or after several readings can be provided with a canceling print.

The printing mechanism can also be used to provide the betting slip with a receipt print. Advantageously, the cancellation or receipt print can contain variable information such as, for example the date, a consecutive number, information about the acceptance station, changing advertising prints and the like.

The sheet tray arranged downstream of the print backup abutment serves to catch the betting slips after their passage through the reading station and the print station, with the sheets falling onto the sheet tray by gravity.

The transport mechanism can in a way known in itself, have two driven roll pairs which define the transport path and which—in respect to the transport direction—are located in front of and behind the reading head, with the print backup abutment being a print roll drivable by the drive for the transport rolls. Thereby one saves the expense for a separate drive for the printing roll.

In a preferred embodiment, the print head is a thermal print head arranged on a pivotal carrier, so that the adjustment of the print head can be realized by a simple pivoting movement of the pivotal carrier.

Instead of directly giving back the betting slip to the customer as a receipt, a special receipt can also be printed. In this case, it is proposed in accordance with the invention that between the transport path and the print backup abutment a delivery gap is provided for a printing medium. Thereby, a receipt can be printed by the same printing mechanism which also provides the cancellation print.

Advantageously, the mechanism has a support for a supply roll of a web shaped printing medium and a delivery mechanism for the printing medium, with a cutting mechanism arranged near the print backup support for separating a printed section from the printing medium.

The cutting mechanism can be arranged in front of or behind the printing roll. In a preferred solution, the cutting mechanism is, however, arranged upstream of the print backup abutment behind a deflector which on one hand guides the escaping slips away from the transport path and on the other hand guides the printing medium to the printing mechanism. Thereby an unintended cutting of the slips coming out of the reading mechanism can be avoided.

Further features and advantages of the invention will be apparent from the following description, which in combination with the accompanying drawings explain the invention by way of exemplary embodiments. The drawings are:

DETAILED DESCRIPTION OF THE PREFERRED EMBODIMENT

Figure 2:
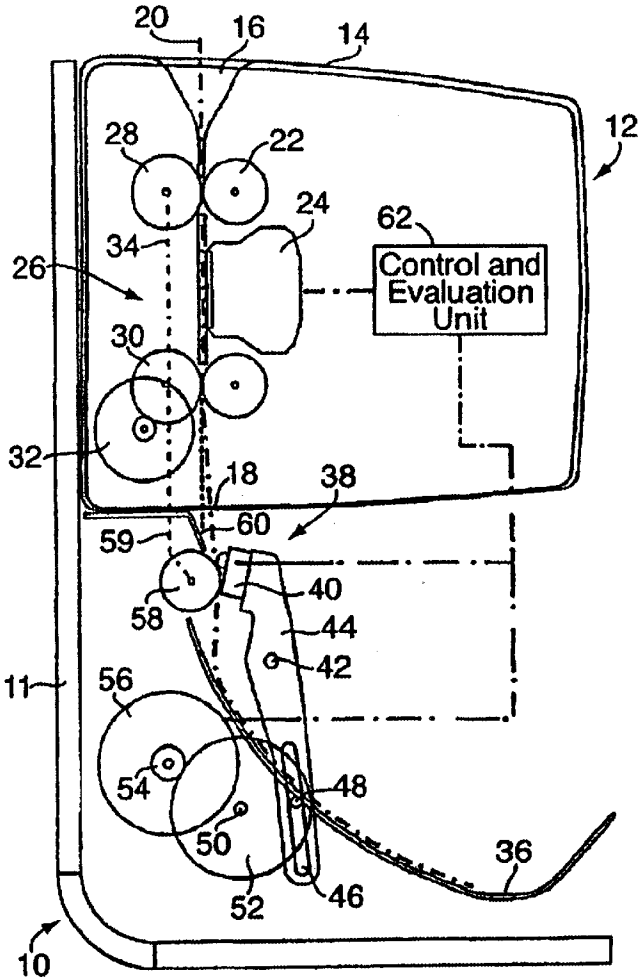
FIGS. 1 and 2 schematic side views of a betting slip processing device embodying the invention in two different positions of the print head.
Figure 1:
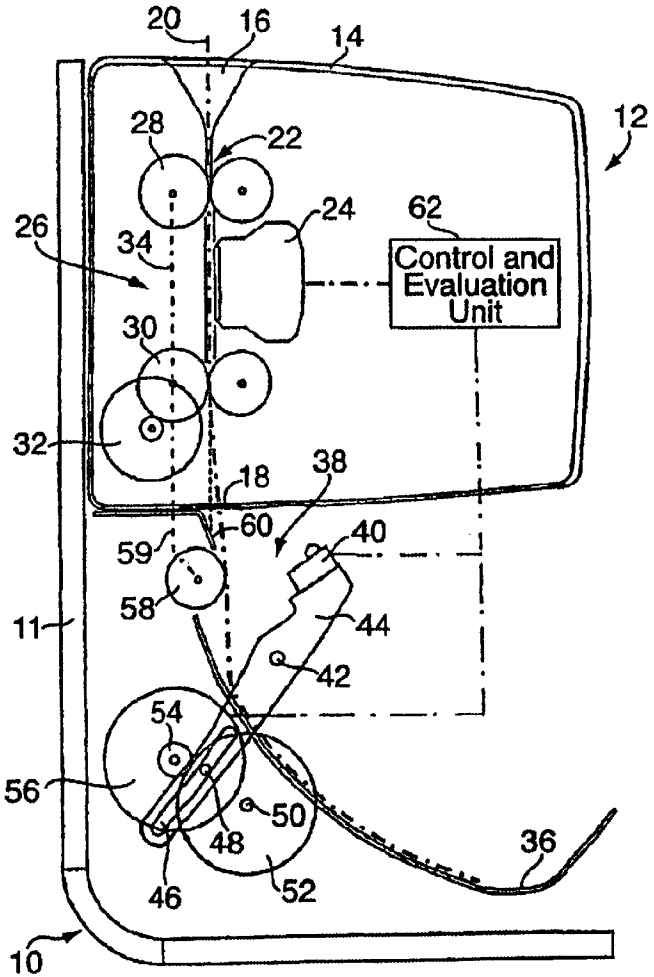

The device illustrated in FIGS. 1 and 2 for the processing of betting slips has a device frame 10 with a vertical wall 11, to which is fastened a reading device, indicated generally at 12, for betting slips. The reading device has a housing 14 having on its upper side an input slot 16 and on its underside an output slot 18 for a betting slip 20 indicated by the dashed and dotted lines. Between the input slot 16 and the output slot 18 there stretches a transport path indicated at 22 adjacent to which a reading head or scanner 24 is arranged. The transport path 22 is defined by a transport device 26 which includes a first transport roll pair 28 above the reading head 24 and a second transport roll pair 30 below the reading head 24. The transport roll pair 30 is driven by a motor 32. The first transport roll pair 28 is driven from the transport roll pair 30 through a drive connection 34.

Below the reading device 12 is a sheet tray 36 formed by a curved piece of sheet metal or the like for catching the betting slips escaping from the output slot 18.

Further, below the output slot 18 of the reading device 12 is arranged a printing mechanism indicated generally at 38. This includes a thermal print head 40, which is fastened to a pivotal carrier 44 supported for pivotal movement about an axis 42. The pivotal carrier 44 is formed in the shape of a two-arm lever and has a longitudinal slot 48 on its lever arm remote from the print head 40, in which longitudinal slot is received a pin 48 which is fastened to a gear wheel 52 supported for rotation about an axis 50. The gear wheel 52 meshes with a pinion 54 positioned on the output shaft of a motor 56. By rotation of the gear wheel 52 by means of the motor 56 the pivotal carrier 44 and with it the print head 40 can be pivoted between the rest position illustrated in FIG. 1 and the printing position illustrated in FIG. 2, at which it lies on a roll shaped print backup abutment 58 arranged immediately below the output slot 18. The roll shaped print backup abutment 58 is likewise driven from the transport roll pair 30 through a drive 59.

Figure 3:
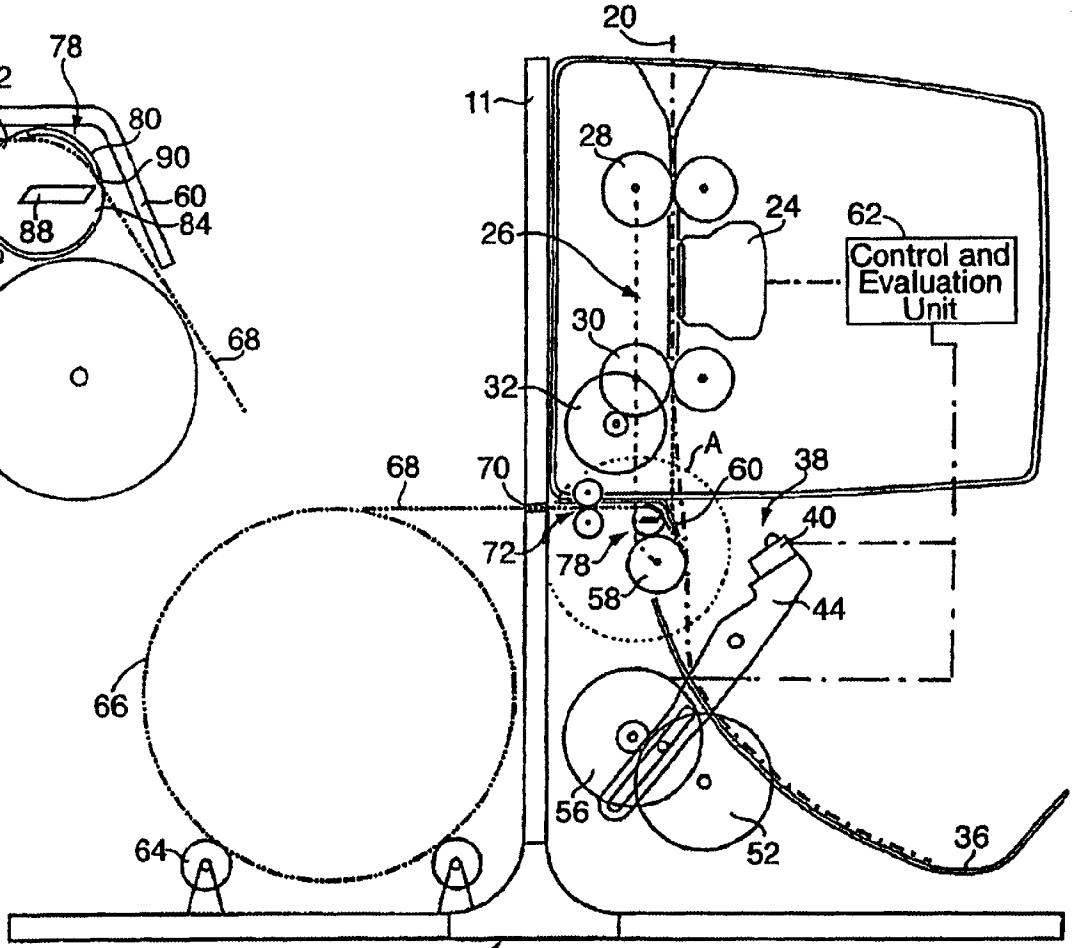
FIG. 3 a view corresponding to that of FIG. 1 of a processing device according to a second embodiment of the invention with a supply roll for a printing medium.

A deflector plate 60 is arranged adjacent to the underside of the housing 14 of the reading device 12, which deflector serves to guide a betting slip 20 escaping from the output slot 18, which slip is shown in FIGS. 1–3 by a dashed line, into the printing gap between the printing backup abutment 58 and the print head 40 as is illustrated by the dashed and dotted line.

The reading head 24 is connected with a control and evaluation unit 62, to which the data read by the reading head is delivered. The control and evaluation unit 62 further controls the printing device 38, that is the print head 40 and the motor 56, as is indicated by the dashed and dotted lines in FIGS. 1 and 2.

The processing apparatus so far described can be used to first read a betting slip filled out by a customer and which slip is moved by the transport device 26 along the transport path 22 past the reading head 24. The data read in this way is delivered to the control and evaluation unit 62. The betting slip 20 is dispensed through the output slot 18 of the housing 12 and is caught by the sheet tray 36.

The device, however, can also be used to read a betting slip receipt or a duplicate of the betting slip from the customer, if the customer wants to redeem a win. The data thereby read by the reading head 24 is then compared in the control and evaluation unit 62 with the already stored data and the possible winning combinations. To prevent a multiple presentation of the betting slip or of the betting slip receipt, the betting slip is subsequently cancelled by means of the printing device 38. For this the printing head 40 is pivoted to its printing position illustrated in FIG. 2 so that the betting slip passing through the output slot 18 on its way to the sheet tray 36 can be provided with a canceling print.

Figure 4:
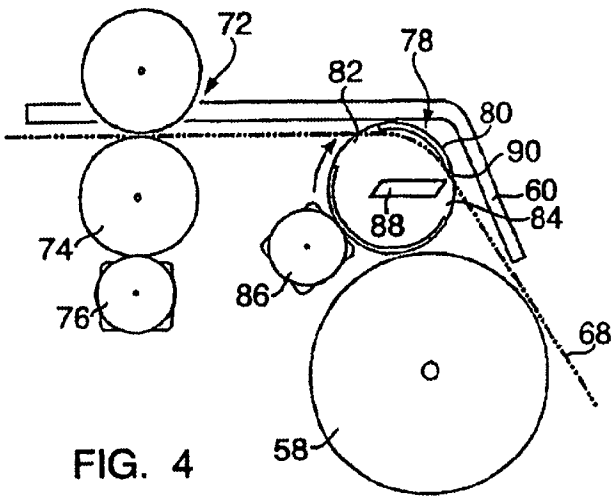
FIG. 4 a representation of the detail A of FIG. 3 in enlarged scale.

The printing device 38 can also be used to print a betting slip receipt. For this reference is made to FIGS. 3 and 4 which show a further embodiment of the invention wherein the parts which correspond to the same parts of the embodiment according to FIGS. 1 and 2 have been provided with the same reference numbers.

A frame 10 of the processing device has a support 64 for a supply roll 66 of a web shaped print medium 68 which is driven through a gap 70 in the vertical frame wall 11 by means of a feed mechanism 72 (FIG. 4) to the printing device 38.

The feed mechanism 72 includes a transport roll pair 74, the rolls of which are driven by a motor 76. The transport roll pair 74 is so arranged that the printing medium path 68 moves along the underside of the deflector plate 60 through a cutting mechanism 78 to the print backup abutment 58.

The cutting mechanism 78 includes, in a way known in itself, a cylindrical rotary knife 80 having two axis parallel slots 82 and 84 for the passage of the printing medium web 68. This rotary knife 80 can be rotated back and forth by a motor 86 about its cylinder axis. Inside of the rotary knife 80 is a stationary blade 88, which cooperates with a knife-edge 90 which limits the slot 84.

If by means of the reading head 24 the data of a betting slip filled out by the customer has been read, the feed mechanism 72 for the print medium 68 is then activated and the print head 40 is moved into its position illustrated by FIG. 2. The data read by the reading head 24 is then printed by means of the print head 40 with the corresponding receipt notations. The printed receipt carrying section or voucher is then separated from the printing medium web 68 by the cutting mechanism 74 and it falls likewise onto the sheet tray 36.

The embodiment illustrated in FIG. 3 thereby makes possible the reading of the betting slip, the printing of a voucher or a receipt, and the reading of the receipt and the cancellation of the same.

Other forms, vouchers and the like can also be read and printed with the previously described devices.

What is a claimed is:

1. A device for the processing of forms, especially betting slips and the like, including a reading station with a transport device forming a slot shaped transport path for the betting slips and the like and a reading head arranged in the way of the transport path, which reading head is connected with a control and evaluation unit, below the reading head in an extension of an at least nearly vertically directed transport path—with reference to the position of the device in use—is arranged a printing device connected with the control and evaluation unit and having a print backup abutment and a print head, which print head is movable between a rest position remote from the print backup abutment and a working position near the print backup abutment, that a sheet tray is arranged downstream of, and below the print backup abutment, such that a betting slip and the like is caused to fall to the sheet tray due to gravity, between the transport path and the backup abutment a feed gap for a printing medium is provided and a cutting mechanism arranged upstream of the print backup abutment beneath a deflector which deflector on one hand guides escaping slips from the transport path and on the other hand guides the printing medium to the printing mechanism.

2. A device according to claim 1, further characterized in that the transport device has at least two driven roll pairs defining the transport path, and which—in respect to the transport direction—are arranged in front of and behind the reading head, and in that the print backup abutment is a printing roll, which is drivable from a drive of the transport rolls.

3. A device according to claim 1, further characterized in that the print head is a thermal print head arranged on a pivotal carrier.

4. A device according to claim 1, further characterized in that it has a support for a supply roll of a web shaped printing medium and a feed mechanism for the printing medium.

5. A device for the processing of forms, especially betting slips and the like, including a reading station with a transport device forming a slot shaped transport path for the betting slips and the like, and a reading head arranged in the way of the transport path, the reading head being connected with a control and evaluation unit, such that below the reading head in an extension of an at least nearly vertically directed transport path—with reference to the position of the device in use—is arranged a printing device connected with the control and evaluation unit and having a print backup abutment and a print head, the print head being movable between a rest position remote from the print backup abutment and a working position near the print backup abutment, a sheet tray being arranged downstream of and below the print backup abutment, and a feed gap for a printing medium being provided between the transport path end the backup abutment, the device further including a support for a supply roll of a web shaped printing medium and a feed mechanism for the printing medium, and near to the print backup abutment being arranged a cutting mechanism for separating a printed section from the printing medium web, the cutting mechanism being arranged upstream of the print backup abutment beneath a deflector such that the deflector on one hand guides escaping slips and the like from the transport path and on the other hand guides the printing medium to the printing mechanism.

* * * * *